United States Patent [19]

Hermanson

[11] Patent Number: 4,510,955

[45] Date of Patent: Apr. 16, 1985

[54] FOLDABLE UMBRELLA

[75] Inventor: Terry Hermanson, New York, N.Y.

[73] Assignee: Mr. Christmas Incorporated, New York, N.Y.

[21] Appl. No.: 500,692

[22] Filed: Jun. 3, 1983

[51] Int. Cl.[3] ..... A45B 19/00

[52] U.S. Cl. ..... 135/25 R

[58] Field of Search ..... 135/25 R, 25 A, 26, 135/98; 248/603, 604

[56] References Cited

U.S. PATENT DOCUMENTS

| | | | |
|---|---|---|---|
| 706,605 | 8/1902 | Slyder | 135/98 X |
| 932,339 | 8/1909 | Slyder | 135/98 X |
| 1,349,281 | 8/1920 | King | 135/25 R |
| 1,890,440 | 12/1932 | Monz et al. | 135/25 R |
| 3,726,295 | 4/1973 | Diaz | 135/25 R |
| 4,360,035 | 11/1982 | Dillmann | 135/25 A X |
| 4,433,699 | 2/1984 | Schultes et al. | 135/25 R X |

FOREIGN PATENT DOCUMENTS

| | | | |
|---|---|---|---|
| 155431 | 9/1903 | Fed. Rep. of Germany | 135/25 R |
| 465545 | 1/1911 | France | 135/25 R |
| 430075 | 8/1967 | Switzerland | 135/25 R |

*Primary Examiner*—Robert A. Hafer
*Assistant Examiner*—Arnold W. Kramer
*Attorney, Agent, or Firm*—Karl W. Flocks; Sheridan Neimark; A. Fred Starobin

[57] ABSTRACT

A folding umbrella which erects and folds with a through-the-roof motion and has a frame of flexible booms, two of which are pivoted at the top end of the handle and two of which are hinged to the pivoted booms, with a canopy of non-stretch material.

14 Claims, 14 Drawing Figures

FOLDABLE UMBRELLA

BACKGROUND OF THE INVENTION

This invention relates to folding umbrellas and more particularly to a new and improved structure having a simple and stronger frame.

Many prior art umbrellas have strong frames to support the canopy but many times a wind suddenly shifts its direction and blows upward into the canopy of the erected umbrella tearing the canopy and breaking the frame by a forced through-the-roof movement. Many are the discarded wrecks of umbrellas that have been subjected to this destructive force.

Additionally, when using an umbrella for protection against a rain storm and then boarding a bus or train and being forced to carry the folded umbrella in close quarters of a crowded bus or train, many times the wet surface of the canopy brushes against clothing or seats causing wetness and discomfort to the person carrying the umbrella and those in the immediate vicinity.

SUMMARY OF THE INVENTION

It is an object of the present invention to provide an umbrella with a canopy and frame which can withstand strong counterwind forces which force the umbrella in a through-the-roof direction without any damage to the canopy or frame.

It is also an object of the present invention to provide such an umbrella with a simple and relatively inexpensive construction.

It is further an object of the present invention to provide an umbrella structure which is useful with both the small personal folding umbrella or a large umbrella, such as is usually used on a beach.

It is still another object of the present invention to provide an umbrella, when carried for personal use, which has the wet surface of the canopy folded to the inside so as not to wet the clothes of the person carrying it or other adjacent surfaces after coming in out of the rain.

Basically, the invention is a folding umbrella having a canopy of non-stretch material with a frame of flexible booms, having those booms which are pivotally attached to the top of the handle and those booms which are hingedly attached to the pivotally attached booms.

Additionally, the invention includes a control lever pivotally connected at the top of the handle and rigidly connected to one of the pivotally connected booms.

BRIEF DESCRIPTION OF THE DRAWINGS

Other objects and advantages of the present invention will become apparent from the following description taken in conjunction with the accompanying drawings wherein.

DETAILED DESCRIPTION OF THE PREFERRED EMBODIMENTS

Figure 1:
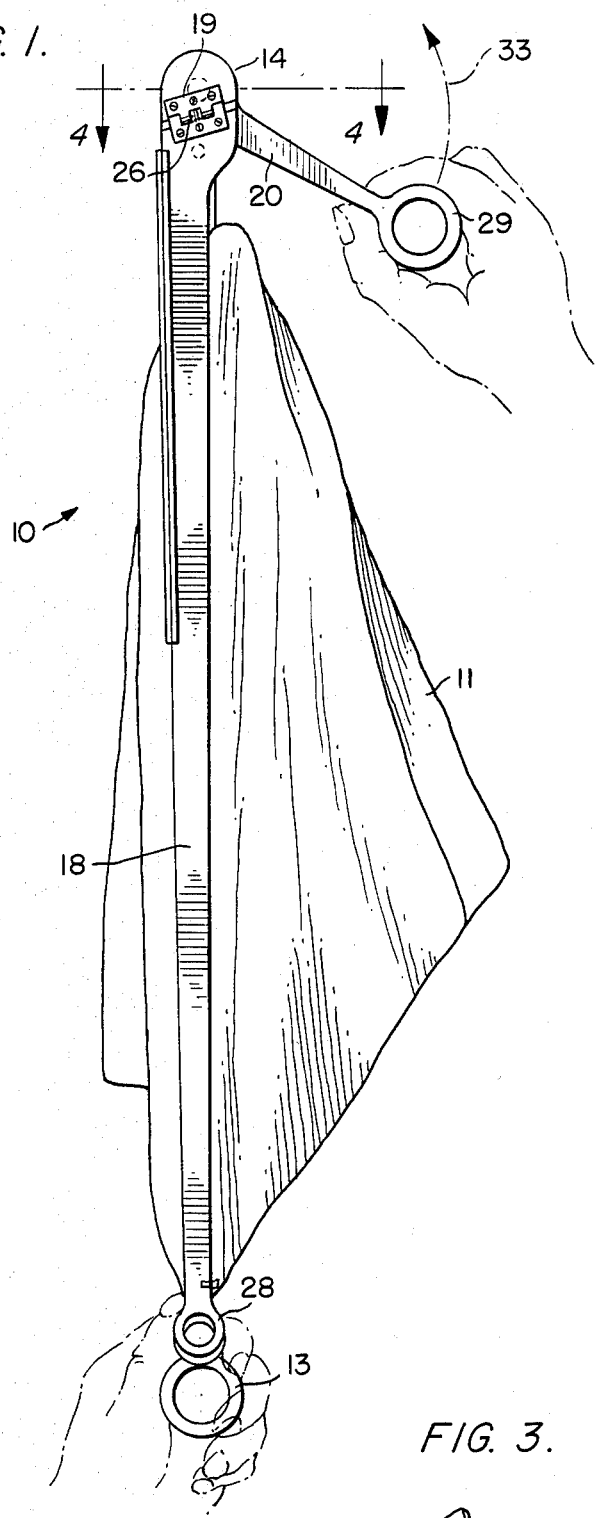
FIG. 1 is a side elevation view of the umbrella of the present invention in a collapsed storage condition and at the start of being opened.
Figure 2:
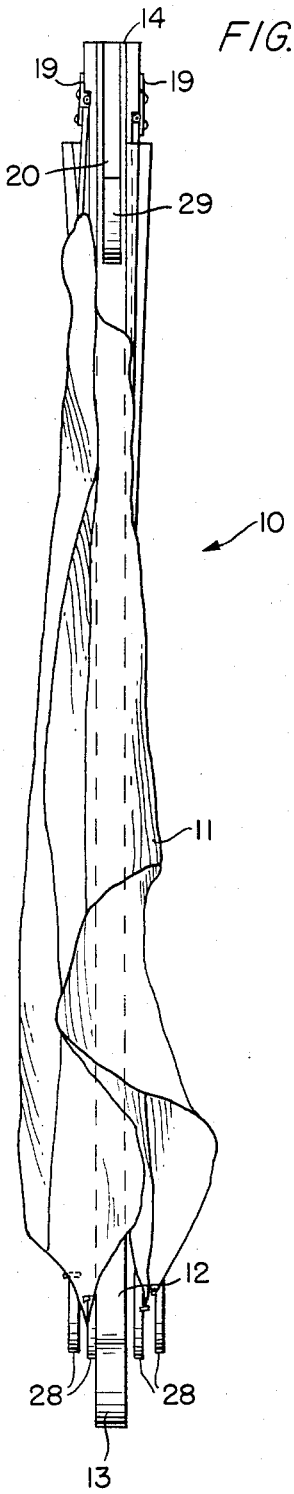
FIG. 2 is a side elevation view with the umbrella of FIG. rotated 90°.
Figure 3:
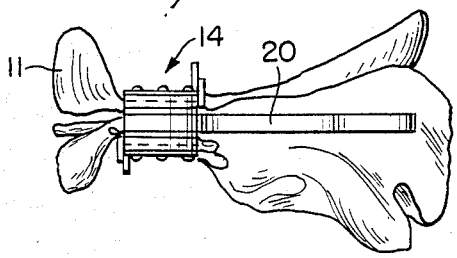
FIG. 3 is a top plan view of the umbrella of FIG. 1.

Referring first to FIGS. 1–3, there is shown folding umbrella 10 with canopy 11 of a non-stretch material. The frame of umbrella 10 consists of a handle portion 12 having a ring 13 or other means to grasp the handle portion 12 when using umbrella 10 in the erected position and a pivotal connecting mechanism 14 at the opposite end of handle portion 12. Booms 15–18 which support canopy 11 in the erected position of the umbrella are connected to handle portion 12 at mechanism 14. Booms 15 and 16 are pivotally connected by pivotal connecting mechanism 14 to handle portion 12 and booms 17 and 18 are hingedly connected respectively by hinges 19 to booms 15 and 16. A control lever 20 is also pivotally connected to handle portion 12 by pivotal connecting mechanism 14.

Figure 4:
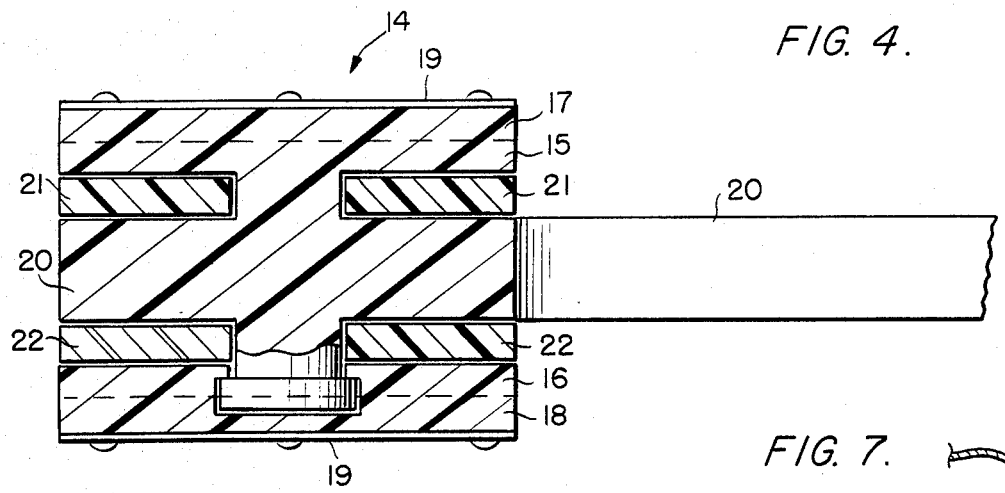
FIG. 4 is an enlarged sectioned view along line 4—4 of FIG. 1.

FIG. 4 shows an enlarged detailed sectioned view of pivotal connecting mechanism 14. In this view, it can be seen that handle portion 12 attaches and supports mechanism 14 on forked ends 21–22. Control lever 20 is rigidly connected to the pivotal end of boom 15 which thereby causes boom 15 and its hingedly attached boom 17 to rotate about connecting mechanism 14 as lever 20 is rotated. On the other hand, boom 16 and its hingedly attached boom 18 can pivot freely relative to both control lever 20 and handle portion 12.

Figure 5:
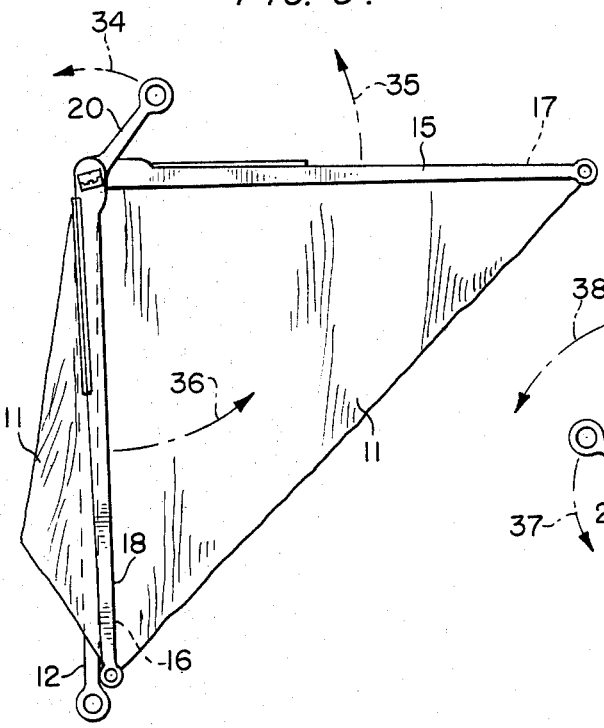
FIG. 5 is a side elevation view of the umbrella of the present invention approximately half open in the process of being opened.
Figure 6:
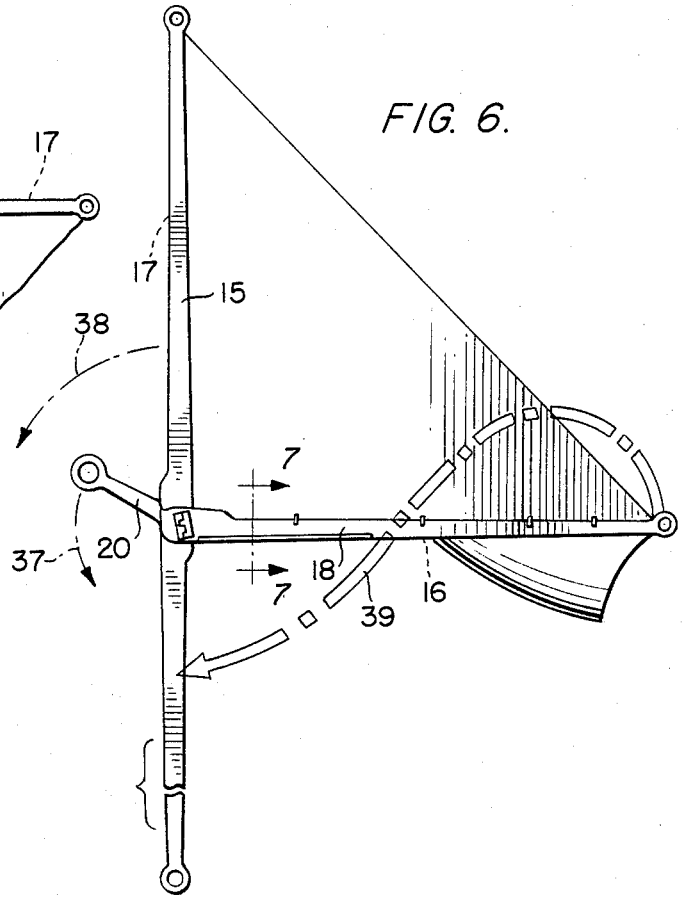
FIG. 6 is a side elevation view of the umbrella of FIG. 5 now approximately three-quarters open.
Figure 8:
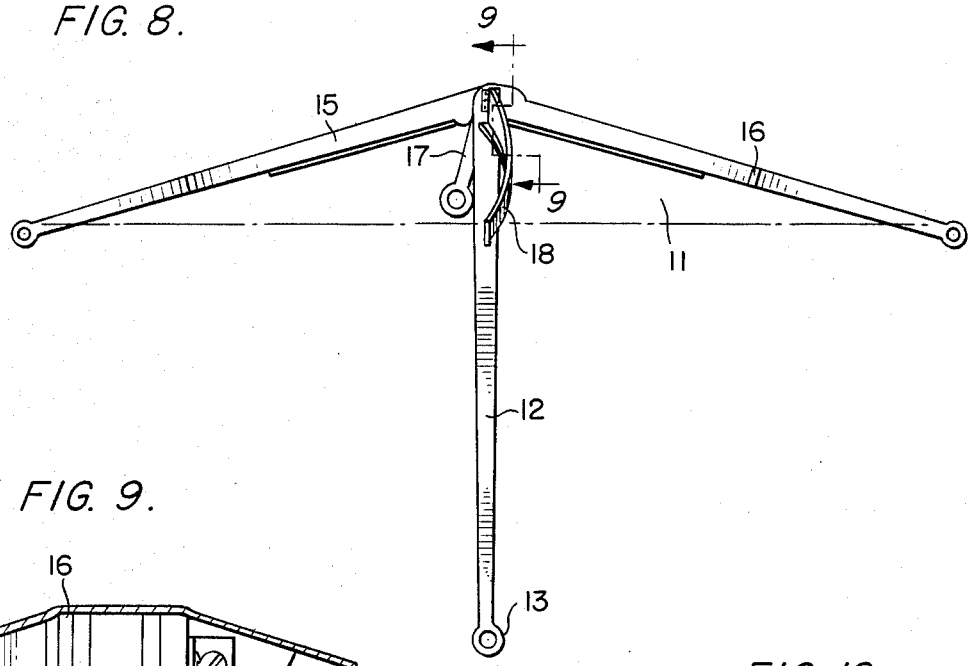
FIG. 8 is a side elevation view of the umbrella of the previous figures, in a fully erected position.
Figure 10:
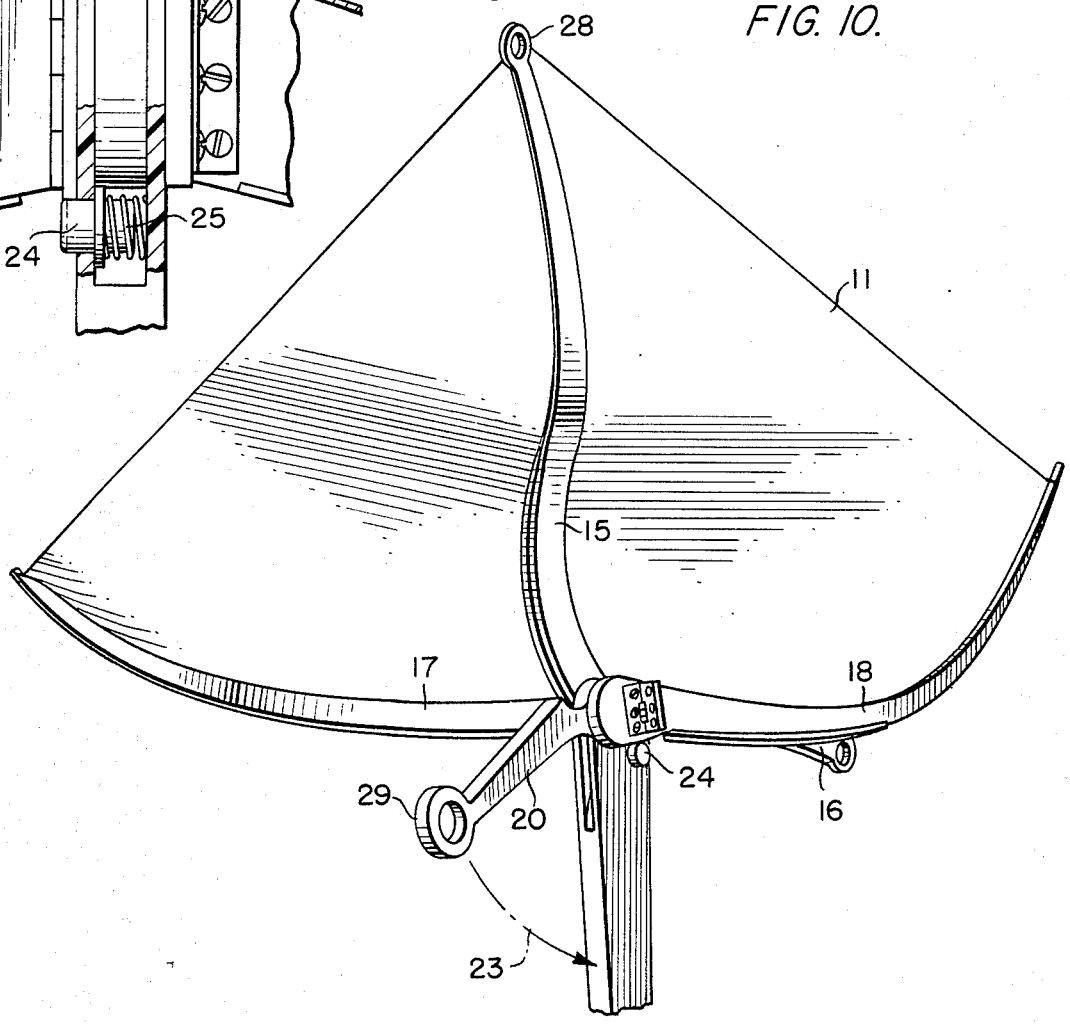
FIG. 10 is a perspective view of the umbrella of the present invention in an almost erected position as it is in the position of snapping through the roof to the erected position.

While FIGS. 1–3 show umbrella 19 in its collapsed or storage condition, FIGS. 5, 6 and 8 show the umbrella in steps of being erected, with FIG. 8 showing it in its fully erected position. FIG. 10 shows umbrella 10 snapping through the roof either to erection when the control lever 20 is moving in the direction shown by arrow 23 or to its collapsed condition when control lever 20 is moved in the opposite direction from arrow 23.

Figure 9:
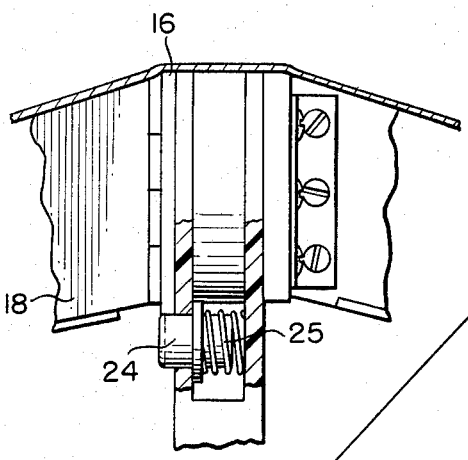
FIG. 9 is a sectioned view along line 9—9 of FIG. 8.

In passing through-the-roof position as in FIG. 10, with non-stretch material used for canopy 11, it is essential that booms 15–18 be flexible as shown by the curvatures induced in the booms at this movement. Canopy 11 is attached to flexible booms 15–18 by tying the material to the ends and at spaced intervals along booms 15–18 to allow for this flexing of the booms. Also at this time, the freely pivotal boom 16 must be stopped at a point in its rotation. This is accomplished by a raised stop or button 24 projecting from handle portion 12. Such stop or button can either be made so as to allow it to be pushed to the raised position by a finger pushing from the opposite side or may be spring mounted as shown in FIG. 9. A spring-mounted button 24 would remain in the raised position and be pushed inward against the bias of spring 25 when starting from the erected position toward the collapsed position and held in by boom 16 passing over it.

Figure 11:
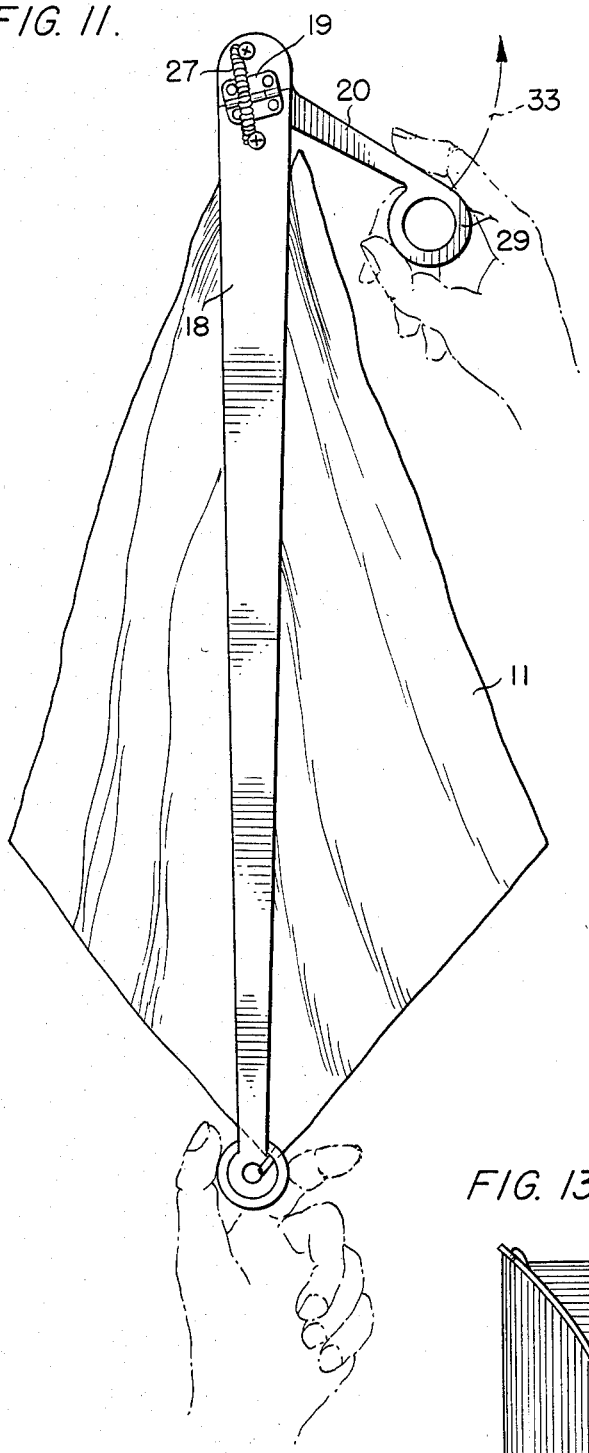
FIG. 11 is a side elevation view of the umbrella of the present invention in a collapsed storage condition having a modified connection of the booms.
Figure 12:
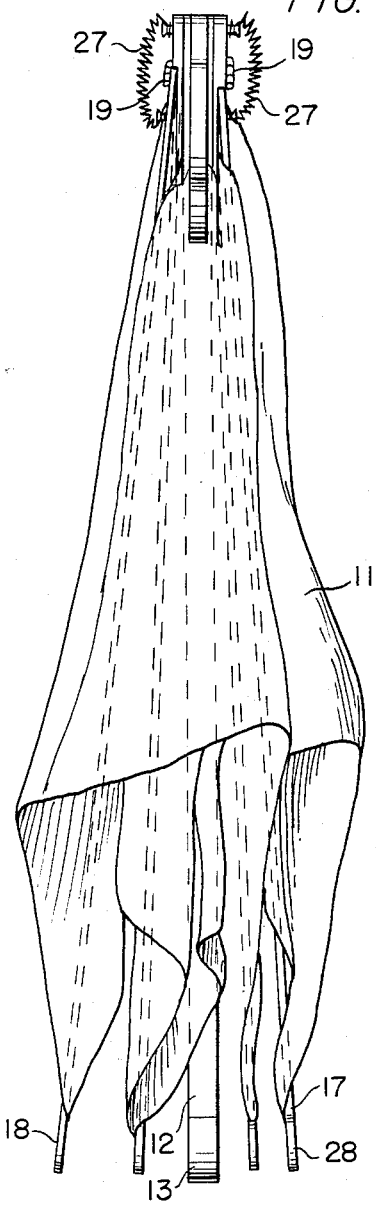
FIG. 12 is a side elevation view with the umbrella of FIG. 11 rotated 90°.
Figure 13:
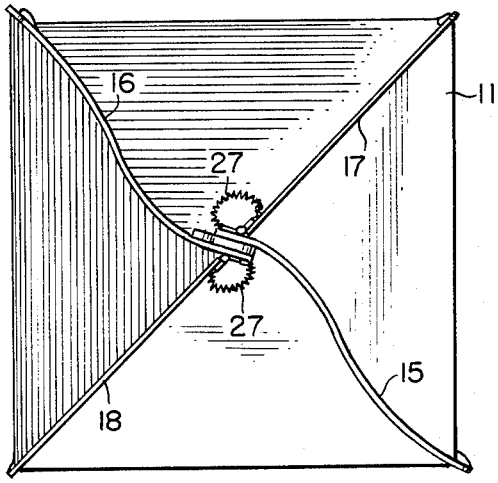
FIG. 13 is a view from below of the umbrella of FIGS. 11 and in an erected condition.

Also while passing through-the-roof position as in FIG. 10 hinged booms 17, 18 must be pushed (or pulled) outwards away from booms 15, 16 to which they are respectively hinged so that the four booms are positioned successively at 90° from each adjacent boom when umbrella 10 reaches its erected position. This is accomplished either by springs 26 located in hinges 19 as in FIGS. 1–10 or by external springs 27 illustrated in FIGS. 11–13. FIGS. 11–12 show this embodiment in its collapsed position and FIG. 13 shows it reaching its erected position.

In order to reduce the chance of injury from the tips of booms 15–18, the tips have all been formed as end rings 28. A ring-shaped end 29 has also been used on the free end of control lever 20 to allow manipulation of lever 20.

Figure 7:
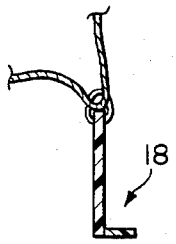
FIG. 7 is a sectioned view along line 7—7 of FIG. 6.
Figure 14:
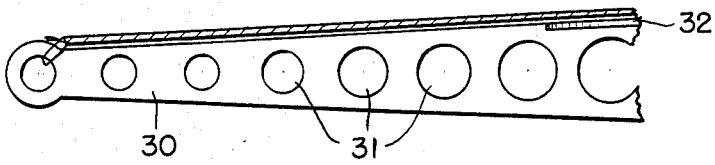
FIG. 14 is a fragmentary view of a modified boom for use with the umbrella of the present invention.

In order to have the required flexibility and also the necessary strength, booms 15–18 may have an L-shape as illustrated in sectioned view of FIG. 7 along at least a portion of its length, preferably at the portions closest to mechanism 14. Boom 30 of FIG. 14 has holes 31 spaced along its length to allow the boom 30 to remain lightweight despite its thickness. Also boom 30 can have the L-shape at its portion close to mechanism 14 as shown by a portion of extending portion 32 forming the L-shape at that point.

The umbrella of the present invention when not in use as protection against precipitation can be carried in the collapsed condition of FIG. 1–3 and 11–12. In such case, the control lever 20 extends in a downward direction at an acute angle from handle portion 12. As such it forms a convenient part to grasp and carry the umbrella. Also as previously noted, if the umbrella is still wet from use, canopy 11 being folded with the wet surface on the inside is away from contact with the person carrying it.

When it is desired to use the umbrella, control lever 20 is rotated in a direction starting away from handle portion 12 as shown by arrows 33 in FIGS. 1 and 11. Rotation of lever 20 as shown in FIG. 5, continues the opening procedure with boom 15 moving with control lever 20 and boom 16 following behind. Arrow 34 indicates further rotation of lever 20 with further movement of booms 15 and 16 indicated by arrows 35 and 36 respectively. When control lever 20 reaches its position shown in FIG. 6, booms 15 and 16 have also reached the positions shown. As control lever 20 continues its rotation as shown by arrow 37, booms 15 and 16 move as shown by arrows 38 and 39 respectively. The point is then reached as depicted in FIG. 10 where due to the non-stretchable material used for canopy 11, the booms 15–18 begin to flex and curve and by the spring action of springs 26 in the hinges or external springs 27 booms 17 and 18 are swung away from booms 15 and 16 respectively to which they are attached by hinges 19. Boom 16 cncounters stop 24 and stops its rotation. Now a sudden snap through the roof of the umbrella takes place and umbrella 10 assumes the fully erected position shown in FIG. 8.

To return umbrella 10 to its collapsed storage position, control lever 20 is rotated in the opposite direction and stop 24 is pressed inward to allow the boom to pass over it. The through-the-roof snapping then takes place with booms 17 and 18 swinging inward to respective booms 15 and 16 to which they are hingedly attached.

The snapping action which is described as moving booms and canopy through-the-roof to erect the umbrella is an action with booms 15–18 first moving outward away from handle portion 12 to a position with the booms extending in a direction away from handle portion 12. As the rotation of control lever 20 is continued, it is being rotated back toward handle portion 12. Boom 15 rigidly connected to control lever 20 through mechanism 14 also continues to rotate until the booms move back toward handle portion 12 to a point at which due to the non-stretchable material of canopy 11, the snapping action takes place and the umbrella is erected.

It will be obvious to those skilled in the art that various changes may be made without departing from the scope of the invention and therefore the invention is not limited to what is shown in the drawings and described in the specification but only as indicated in the appended claims.

I claim:

1. An umbrella comprising a canopy, flexible canopy supporting booms attached to said canopy at their ends and at spaced intervals along the upper surface of said booms with the umbrella in the open condition, a handle portion, a connecting means at one end of said handle portion pivotally connecting said booms to said handle portion, a control lever extending from and pivotally connected to said handle portion at said connecting means to pivot about an axis substantially perpendicular to the longitudinal axis of said handle portion, at least a first one of said booms rigidly connected to said control lever to pivot at said connecting means with a pivotal movement of said control lever, a second one of said booms pivotally connected to said connecting means in a manner to pivot freely relative to said control lever about substantially the same perpendicular axis of rotation as said first one of said booms upon being pulled by said canopy which is pulled by rotation of said first one of said booms, third and fourth ones of said booms hingedly connected respectively to said first and second ones of said booms and extending with the umbrella in the open condition with said first and second ones in a plane perpendicular to said third and fourth ones of said booms, said booms and handle lying parallel to each other and extending in the same direction from said connecting means, and said control lever extending from said connecting means, when the umbrella is in the collapsed condition.

2. The umbrella of claim 1, further characterized by hinge means to hingedly connected said third and fourth ones of said booms respectively to said first and second ones of said booms.

3. The umbrella of claim 2, further characterized by spring means connected on hingedly connected pairs of said booms to bias said booms in said pairs of booms away from each other.

4. The umbrella of claim 3, further characterized by said hinge means and said spring means being an integral spring-hinge combination connecting said booms of each of said pair of booms.

5. The umbrella of claim 3, further characterized by said springs means being a spring in tension connected between each of said booms of said pairs of booms.

6. The umbrella of claim 1, further characterized by said canopy being of a non-stretchable material.

7. The umbrella of claim 1, further characterized by rounded ends of the free ends of each of said booms.

8. The umbrella of claim 1, further characterized by grasping means on said handle portion and said control lever.

9. The umbrella of claim 1, further characterized by said control lever extending at an acute angle from said handle portion when the umbrella is in a collapsed storage position.

10. The umbrella of claim 1, further characterized by said booms having an L-shape along at least a portion of their length toward the ends nearer said pivotally connecting means.

11. The umbrella of claim 1, further characterized by said booms formed of flat lateral surfaces with holes therethrough spaced along their length.

12. The umbrella of claim 1, further characterized by a stop positioned to abut said second one of said booms when the umbrella is in an erected position.

13. The umbrella of claim 12, further characterized by said stop being spring-mounted biased in a raised position on said handle portion.

14. The umbrella of claim 1, further characterized by said handle portion having a groove therein on the end near said connecting means to receive at least a portion of said control lever when the umbrella is in the erected position.

* * * * *